US006047883A

United States Patent [19]

Calvert et al.

[11] Patent Number: 6,047,883

[45] Date of Patent: Apr. 11, 2000

[54] BAGLESS BARRIER PAPERBOARD CONTAINER WITH A TAMPER EVIDENT RECLOSABLE FITMENT

[75] Inventors: Barry Gene Calvert, Covington; Janice Lynn Kirkham, Lexington, both of Va.; Jack Leong Hung Lum, Laurel, Md.

[73] Assignee: Westvaco Corporation, New York, N.Y.

[21] Appl. No.: 09/149,236

[22] Filed: Sep. 8, 1998

[51] Int. Cl.[7] ..... B65D 5/42

[52] U.S. Cl. ..... 229/125.39; 229/123.3; 229/137; 383/86; 383/89

[58] Field of Search ..... 229/123.2, 123.3, 229/125.37, 125.39, 137; 383/86, 89, 90, 91

[56] References Cited

U.S. PATENT DOCUMENTS

| | | | |
|---|---|---|---|
| 2,071,745 | 2/1937 | Higginbottom | 383/91 |
| 2,087,940 | 7/1937 | Scott | 229/125.37 |
| 3,081,927 | 3/1963 | Hayhurst | 229/125.37 |
| 3,326,449 | 6/1967 | Dickson . | |
| 3,357,152 | 12/1967 | Geigel . | |
| 3,375,969 | 4/1968 | Davis, Jr. . | |
| 3,439,866 | 4/1969 | Kuhnle | 383/89 |
| 3,608,707 | 9/1971 | Miller | 229/125.39 |
| 4,055,109 | 10/1977 | Kan . | |
| 4,109,822 | 8/1978 | Egli . | |
| 4,215,783 | 8/1980 | VanderLugt, Jr. . | |
| 4,249,693 | 2/1981 | Diaz . | |
| 4,353,497 | 10/1982 | Bustin . | |
| 4,524,459 | 6/1985 | Titchenal . | |
| 4,561,107 | 12/1985 | Herder . | |
| 4,591,091 | 5/1986 | Wise . | |
| 4,638,912 | 1/1987 | Graf | 229/125.39 |
| 4,706,297 | 11/1987 | Ausnit | 383/89 |
| 4,768,703 | 9/1988 | Sosler et al. . | |
| 4,771,938 | 9/1988 | Hambleton . | |
| 4,947,525 | 8/1990 | Van Erden . | |
| 5,080,253 | 1/1992 | Zieke . | |
| 5,096,306 | 3/1992 | Stenström et al. . | |
| 5,157,811 | 10/1992 | Bodolay . | |
| 5,427,267 | 6/1995 | Willman . | |
| 5,437,406 | 8/1995 | Gordon et al. . | |
| 5,464,093 | 11/1995 | Hogan . | |
| 5,507,431 | 4/1996 | Bertone . | |
| 5,551,127 | 9/1996 | May . | |
| 5,632,404 | 5/1997 | Walsh . | |
| 5,647,100 | 7/1997 | Porchia et al. . | |
| 5,664,303 | 9/1997 | Johnson . | |
| 5,716,473 | 2/1998 | Gordon et al. . | |

*Primary Examiner*—Gary E. Elkins
*Attorney, Agent, or Firm*—J. R. McDaniel; R. L. Schmalz

[57] ABSTRACT

This invention relates to a fin sealed box, an integrate barrier coating and a relockable fitment closure that are combine to create a novel package which is easily formed, filled and sealed by the packager and easily opened and reclosed by the consumer. Such structures of this type, generally, employ reclose feature such as an audibly relockable fitment break-away button snap, an tear-away tab, to add even more convenience and tamper-evidence for the consumer.

9 Claims, 19 Drawing Sheets

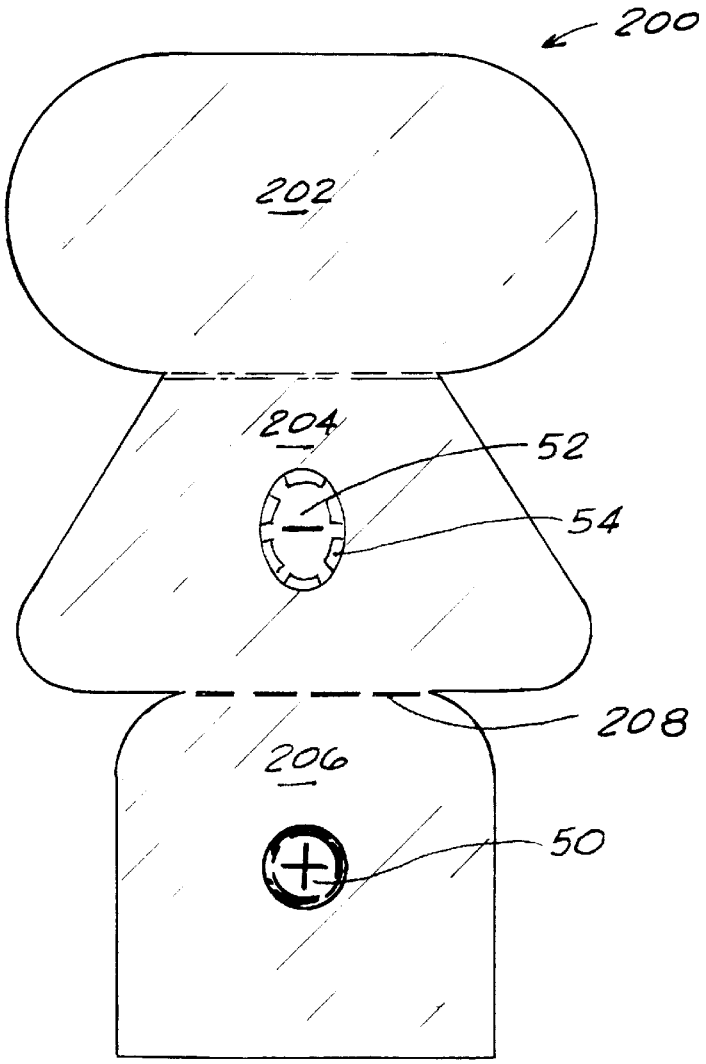
FIG. 15a
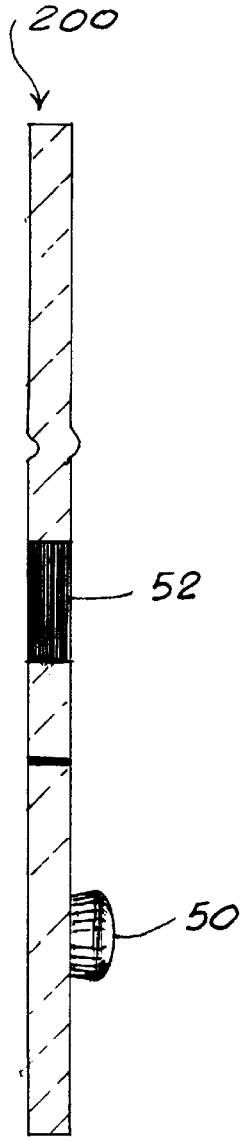
FIG. 15b
FIG. 15

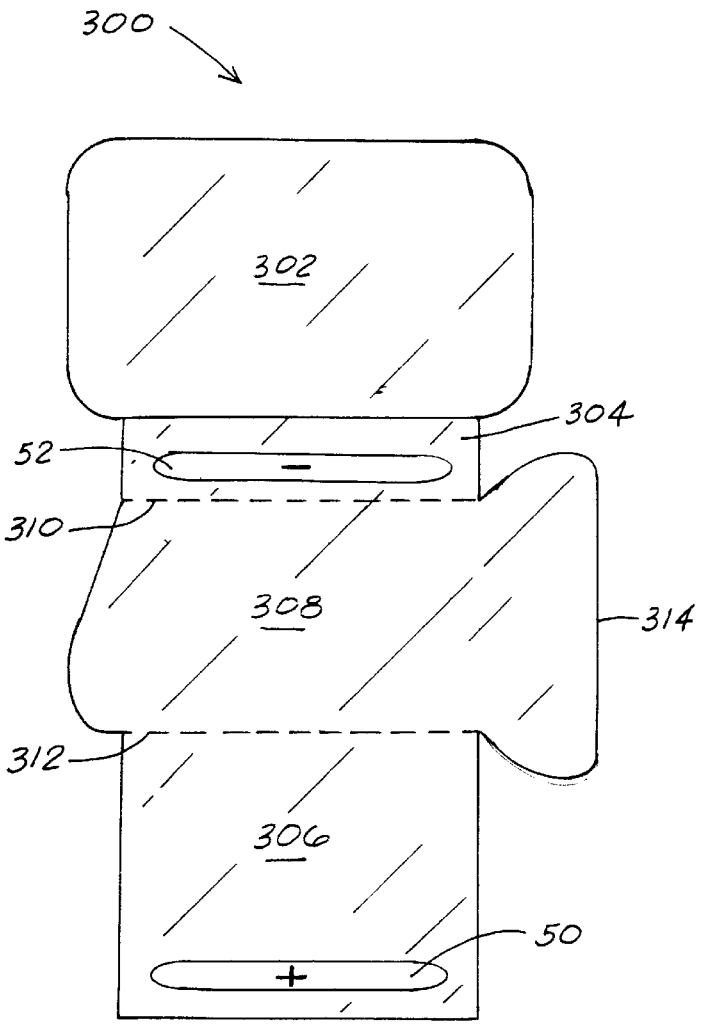
FIG. 17a
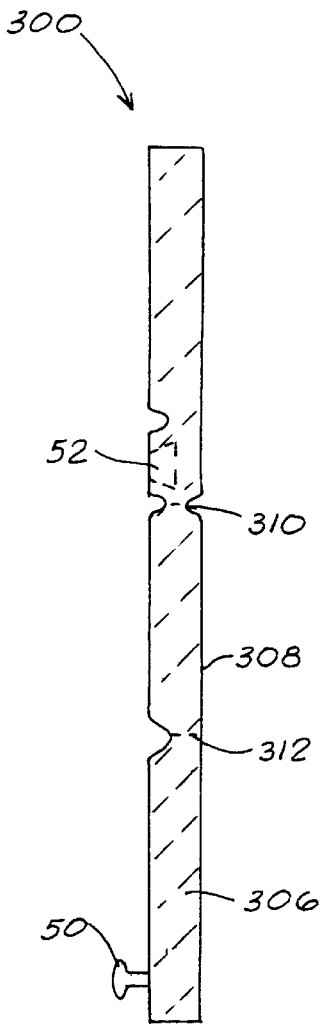
FIG. 17b
FIG. 17

BAGLESS BARRIER PAPERBOARD CONTAINER WITH A TAMPER EVIDENT RECLOSABLE FITMENT

BACKGROUND OF THE INVENTION

1. Field of the Invention

This invention relates to a fin sealed box, an integrate barrier coating and a relockable fitment closure that are combine to create a novel package which is easily formed, filled and sealed by the packager and easily opened and reclosed by the consumer Such structures of this type, generally, employ reclose feature such as an audibly relockable fitment, breakaway button snap, an tear-away tab, to add even more convenience and tamper-evidence for the consumer.

2. Description of the Related Art

It is known, in the food packaging industry, to make use of stand-up pouches. Exemplary of such prior art are U.S. Pat. No. 4,055,109 ('109) to O. Kan, entitled "Method and Apparatus for Producing Shelf-Standing Bags" and U.S. Pat. No. 4,353,497 ('497) to F. Bustin, entitled "Free-Standing Thermoplastic Bag Construction". While these bags offer good barrier properties and reclosability, they lack the rigidity for delicate, flaky food items.

It is also known to employ outer cartons with inner liners Exemplary of such prior art are U.S. Pat. No. 4,109,822 ('822) to A. Egli, entitled "Package Composed of a Inner Bag Enclosed by an Outer Container", U.S. Pat. No. 5,464,093 ('093) to S. D. Hogan, entitled "Tobacco Package With Disposal Pouch", and U.S. Pat. No. 5,632,404 ('404) to J. C. Walsh, entitled "Carton Blank". While these hybrid bag/box structures may improve filling efficiencies, they are expensive to make due to lamination costs and include an inner bag which must be eliminated, while maintaining the necessary barrier properties.

It is further known to employ a bagless box with a thermo-plastic coating and a reclosable top. Exemplary of such prior art are U.S. Pat. No. 5,437,406 ('406) to R. L. Gordon et al., entitled "Semi-Rigid Cereal Carton" and U.S. Pat. No. 5,716,4 ('473) to R. L. Gordon et al., entitled "Method of Making a Semi-Rigid Cereal Carton". While the '406 and '473 patents disclose bagless containers, these containers are not stackable and lack a positive reclose feature. Also, their triangular profiles require more paperboard surface per volume than a rectangular box.

Finally, it is known to employ various reclose features on food cartons. Exemplary of such prior art are U.S. Pat. No. 4,215,783 ('783) to P. VanderLugt, Jr., entitled "Carton With Reclosure Feature", U.S. Pat. No. 4,249,693 ('693) to M. Diaz, entitled "Cardboard Container Cover", U.S. Pat. No. 4,771,938 ('938) to T. P. Hambleton, entitled "Carton With Reclosable Membrane Liner", and U.S. Pat. No. 5,507,431 ('431) to A. Bertone, entitled "Closure Clasp for a Gable-Topped Food Carton". All of these references suffer from various deficiencies. For example, the '431 reference lacks the necessary geometry for dry food packaging. Also, the opening in the '431 reference is not large enough for the pouring of cereal or dispensing of other dry food products, such as crackers. The '938 reference mentions the use of pressure sensitive adhesives for reclosing; however, it is well known that these materials become contaminated with product during normal use and are, therefore, rendered useless. The '693 reference describes a fitment which is used as a measuring device. However, this '693 fitment would not work to secure a flap closed. The '783 reference describes a non-conventional paperboard opening feature. However, this type of feature lacks durability with multiple uses. Finally, tamper evidence is not addressed in any of these references.

It is apparent from the above that there exists a need in the art for a paperboard container which is rigid and stackable, and includes a positive reclose, tamper evident feature, but which at the same time avoids the use of an inner bag.

It is a purpose of this invention to fulfill this and other needs in the art in a manner more apparent to the skilled artisan once given the following disclosure.

SUMMARY OF THE INVENTION

Generally speaking, this invention fulfills these needs by providing a bagless, paperboard container for dry food packaging having a locking, reclosable means, comprising of a blank having inner and outer sides with printed graphics being located on the outer side and a coating layer located on the inner side, and further including a first side panel means hingedly connected to a second side panel means along a first vertical side panel score line means; a third side panel means hingedly connected to the second side panel means along a second vertical side panel score line means; a fourth side panel means hingedly connected to the third side panel means along a third vertical side panel score line means; a first end panel means hingedly connected to the first side panel means; a second end panel means hingedly connected to the third side panel means; a first fold over panel means hingedly connected to the first end panel means; a second fold over panel means hingedly connected to the second end panel means; a flap means hingedly connected to the second fold over panel means; a flap triangular end panel means hingedly connected to the second and fourth side panel means; a plurality of fold-back panel means hingedly connected to the triangular end panel means and the first and second end panel means; a plurality of inner rib panel means hingedly connected to the fold-back panel means and the first and second fold over panel means; and a locking, reclosable means for holding the flap means in a reclosable and lockable condition.

In certain preferred embodiments, the locking, reclosable means can be located between the flap means and the end panel means. Also, the locking, reclosable means can be located between the end panel means and the side panel means. Also, the locking, reclosable means can be located between the flap means and the side panel means. Also, the locking, reclosable means can be located between the end panel means and the fold over panel means. Also, the locking, reclosable means can be located between the fold over panel means, end panel means and side panel means. Also, the locking, reclosable means can be located between the inner rib panel means and side panel means. Also, the locking, reclosable means can be located between the triangular end panel means and side panel means. Finally, the locking, reclosable means is constructed of any suitable, polymeric material.

In another further preferred embodiment, the use of the sealed box with the integrated barrier coating and the relockable closure combine to create a novel package which is easily formed, filled and sealed by the packager and easily opened and reclosed by the consumer.

The preferred paperboard container, according to this invention, offers the following advantages: elimination of the bag; reclosability; lockability; hermetic sealability; excellent moisture vapor characteristics; excellent flavor barrier characteristics; good rigidity; good impact protection; good stability; good durability; ease of manufacture;

and excellent economy. In fact, in many of the preferred embodiments, these factors of elimination of the bag, reclosability, lockability, hermetic sealability, vapor characteristics, flavor barrier characteristics, rigidity, impact protection and manufacturing are optimized to the extent that is considerably higher than heretofore achieved in prior, known paperboard containers.

The above and other features of the present invention, which will become more apparent as the description proceeds, are best understood by considering the following detailed description in conjunction with the accompanying drawings, wherein like characters represent like parts throughout the several views and in which:

BRIEF DESCRIPTION OF THE DRAWINGS

FIG. 15*a* is a front view of the locking, reclosable device used in the bagless, barrier paperboard box and FIG. 15*b* is a side view of the locking, reclosable device of FIG. 15*a*, according to the present invention;

FIG. 17*a* is a front view of another locking, reclosable device used in the bagless, barrier paperboard box and FIG. 17*b* is a side view of the locking, reclosable device of FIG. 17*a*, according to the present invention;

DETAILED DESCRIPTION OF THE INVENTION

Figure 1:
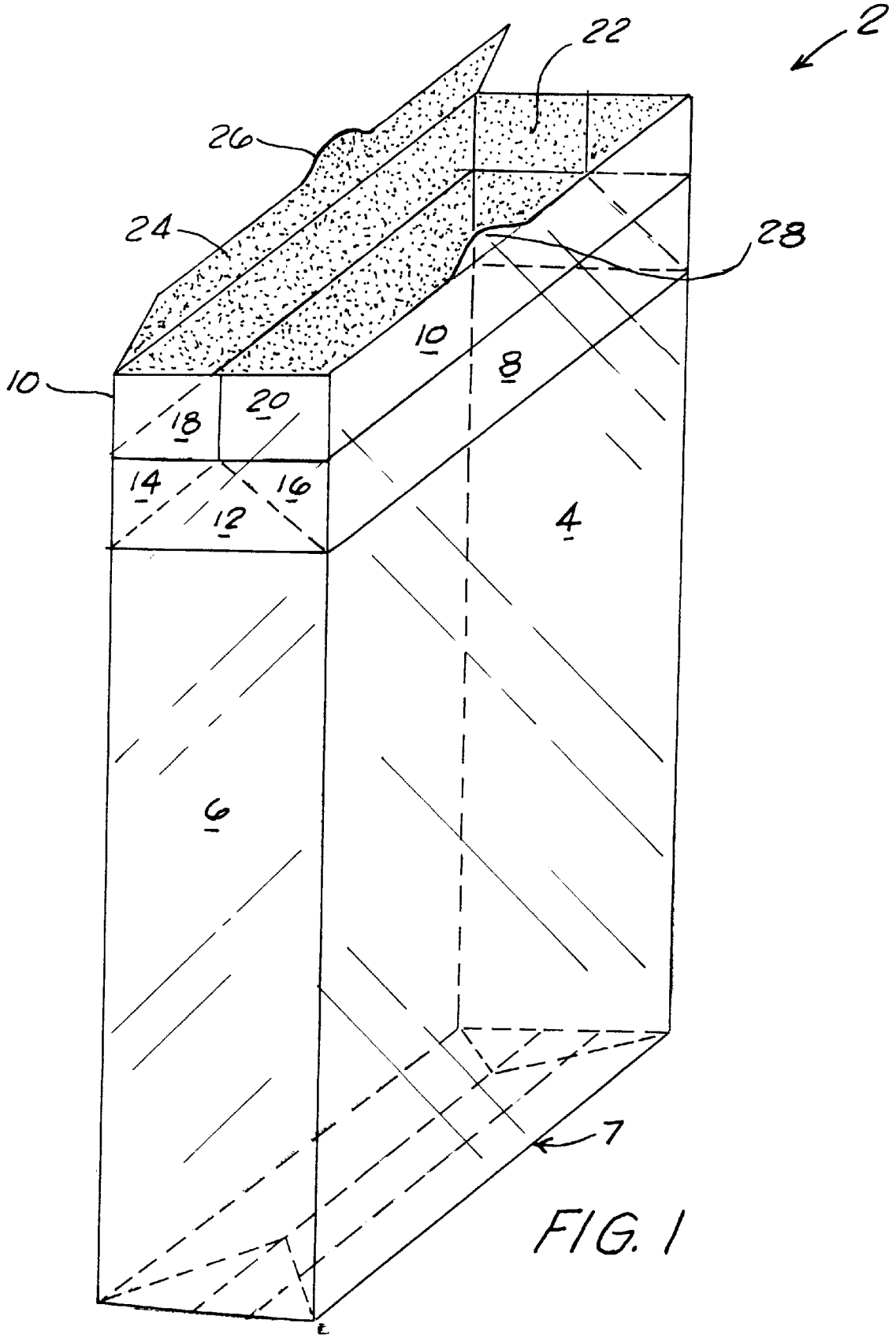
FIG. 1 is an isometric view of a bagless, barrier paperboard box, according to the present invention.

With reference first to FIG. 1, there is illustrated a advantageous environment for use of the concepts of this invention. A bagless, barrier paperboard box 2 is illustrated. Box 2 includes, in part, side panels 4 and 6, bottom 7, end panel 8, fold over panel 10, triangular end panel 12, fold-back panels 14 and 16, inner rib panels 18 and 20, conventional polymeric coating 22, flap 24 and tabs 26 and 28.

Paperboard is used as a substrate for box 2 and is, typically, constructed from a 0.018 inch thick bleached sulphate sheet, solid unbleached sulphate (SUS) or clay coated newsback (CCNB). Definitively, the term paperboard describes paper within the thickness range of 0.008 to 0.028 inches. The invention is relevant to the full scope of such a range, as applied to packaging and beyond.

When used for food carton stock, the paperboard is usually clay coated on a least one side surface and occasionally on both sides. The paperboard trade characterizes a paperboard web or sheet that has been clay coated on one side as C1S and C2S for a sheet coated on both sides. Compositionally, the paperboard coating is a fluidized blend of minerals such as coating clay, calcium carbonate and/or titanium dioxide with starch or adhesives which is smoothly applied to the traveling surface. Successive densification and polishing by calendering finishes the mineral coated surface to a high degree of smoothness and a superior graphic print surface.

When C1S paperboard is used for food packaging, the clay coated surface is prepared as the outside surface, i.e., the surface not in contact with the food. Pursuant to the present invention, the other side (the side in contact with the food) is coated with a conventional polymeric coating which exhibits excellent moisture vapor, oxygen and flavor barrier characteristics.

It must also be pointed out that bottom 7 is conventionally constructed to provide a rigid bottom for box 2 and allow box 2 to be easily stacked upon other similarly constructed boxes.

As can be further seen in the drawing, side panels 4 and 6 are connected to each other along a conventional score line. Also, side panel 4 is connected to end panel 8 along a score line and end panel 8 is connected to fold over panel 10 along a conventional score line. Also, the other fold over panel 10 is connected to flap 24 along a conventional score line. Side panel 6 is connected to triangular end panel 12 along a conventional score line. Triangular end panel 12 is connected to fold-back panels 14 and 16 along conventional score lines. Fold-back panels 14 and 16 are connected to inner rib panels 18 and 20, respectively, along conventional score lines. Inner rib panels 18 and 20 are connected along a conventional score line. It is to be understood that flap 24 prevents the raw edges of the paperboard and the box opening from being exposed during reclosure and tabs 26 and 28 are used by the end-user in that tabs 26 and 28 are pulled by the consumer to more easily open paperboard box 2. Tab 28 is connected to panel 10 by a conventional score line.

Figure 2:
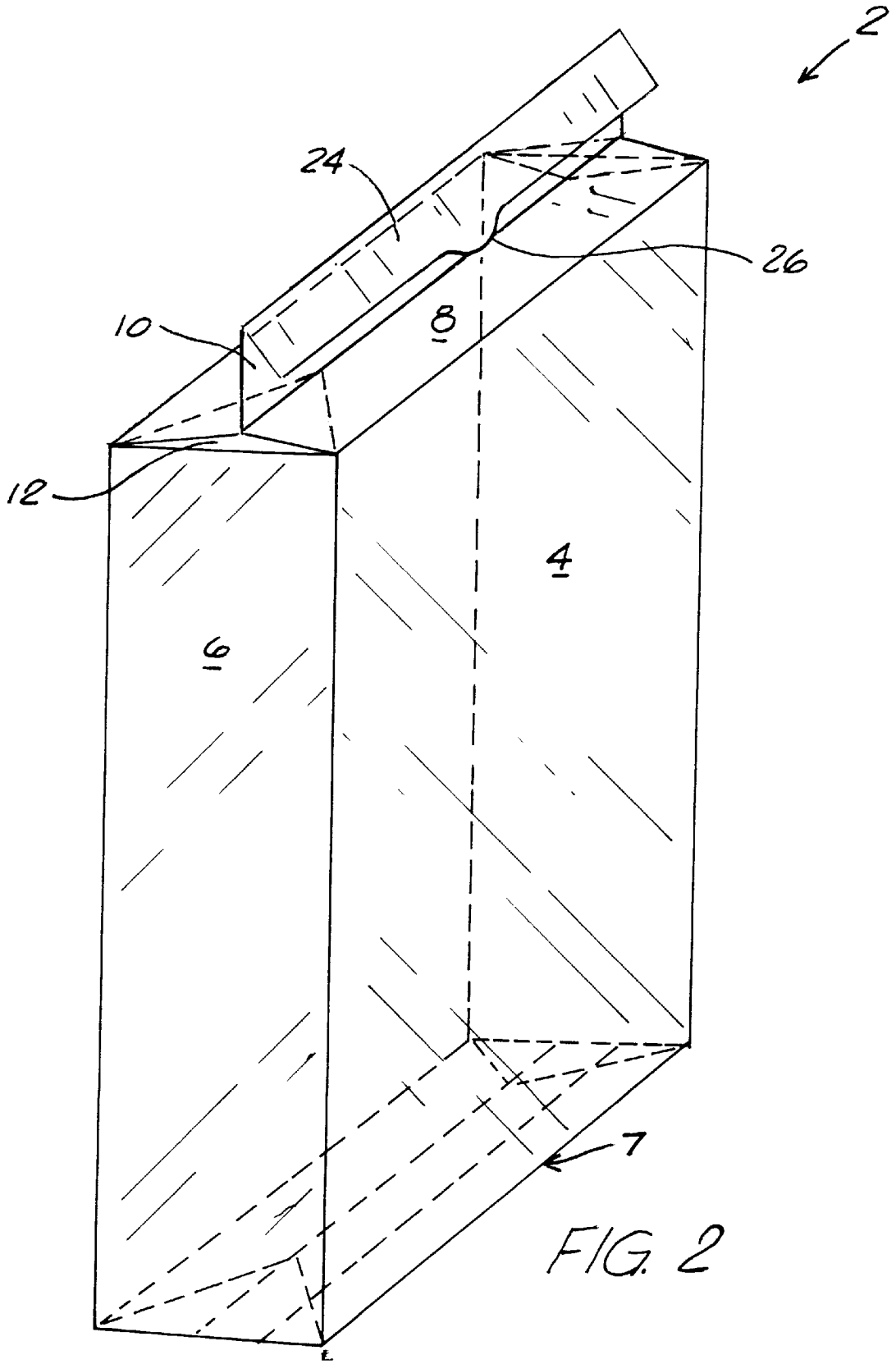
FIG. 2 is an isometric illustration of the bagless, barrier paperboard box of FIG. 1 in a folded condition, prior to locking, according to the present invention.

FIG. 2 is the box of FIG. 1 folded in such a manner to permit a gable-top-like seal on the top of box 2. As can be seen, flap 24 folded over fold over panel 10.

Figure 3:
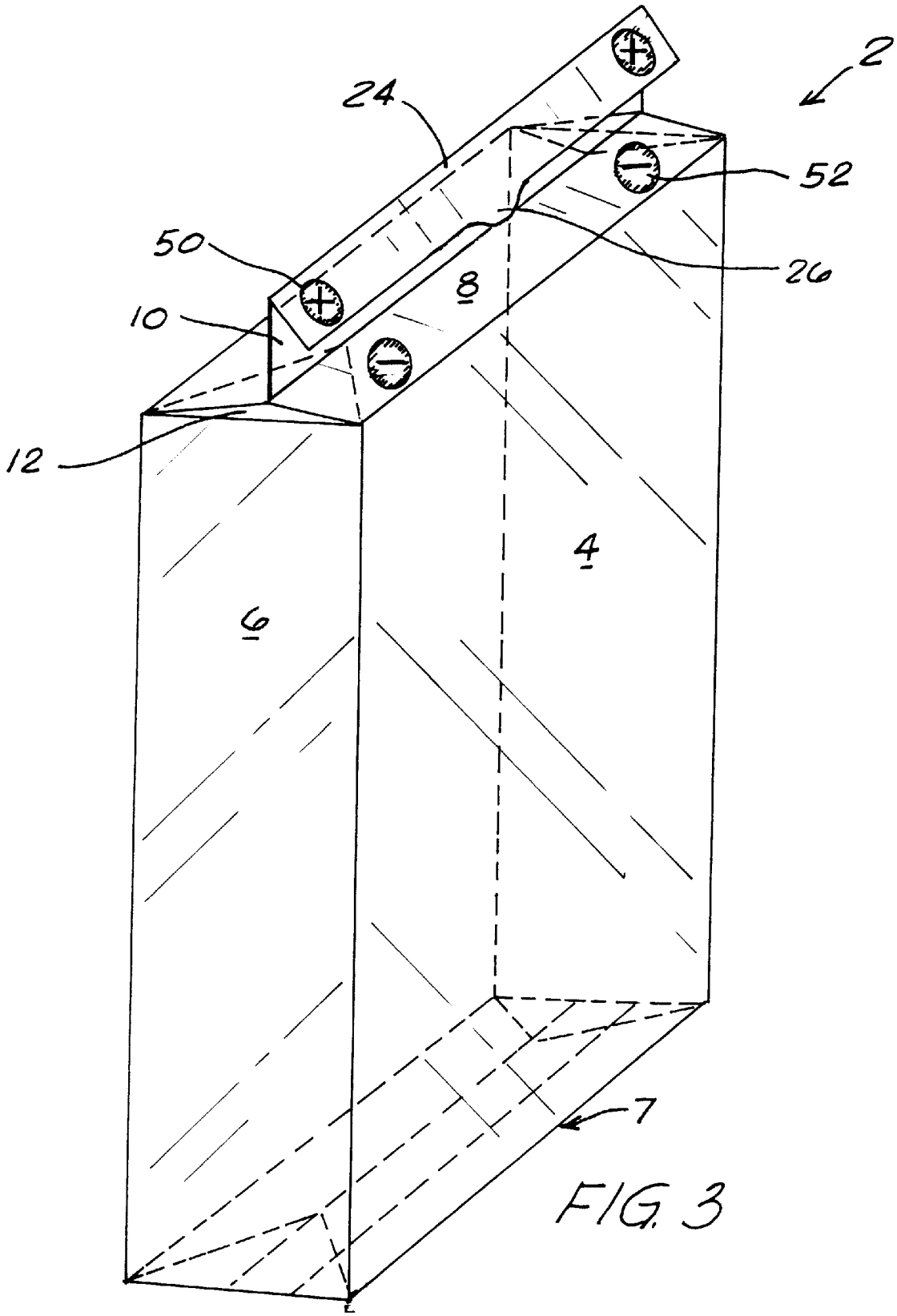
FIG. 3 is an isometric view of the bagless, barrier paperboard with the reclose feature, according to the present invention.

FIG. 3 illustrates locking-reclosable features or fitments 200. In particular, a button snap is used, which is more clearly shown in FIGS. 15*a* and 15*b*. However, it is to be understood that Velcro®, adhesive strips or tin ties and other reclose features can be used to lock down end panel 8 and flap 24. 50 (+) and 52 (−) represent the male and female fasteners of the reclosure device 200, which can be seen more clearly.

Figure 4:
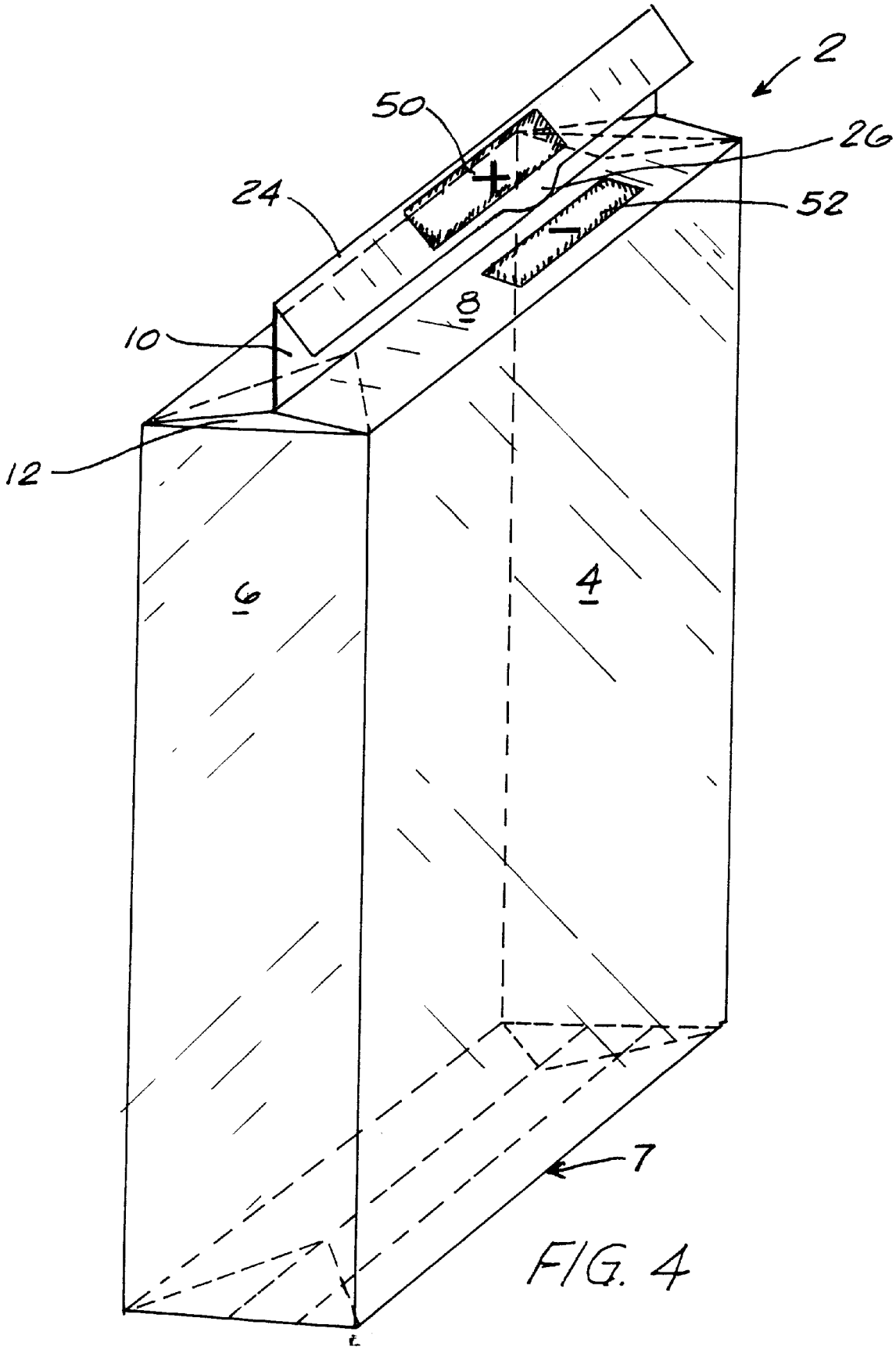
FIG. 4 is an isometric view of another bagless, barrier paperboard box with a reclose feature, according to the present is invention.

FIG. 4 is similar to FIG. 3 except that FIG. 4 utilizes a fastening bar area instead of corner buttons. In this manner, fasteners 50 and 52 can be centered located along flap 24 and end panel 8, respectively.

Figure 5:
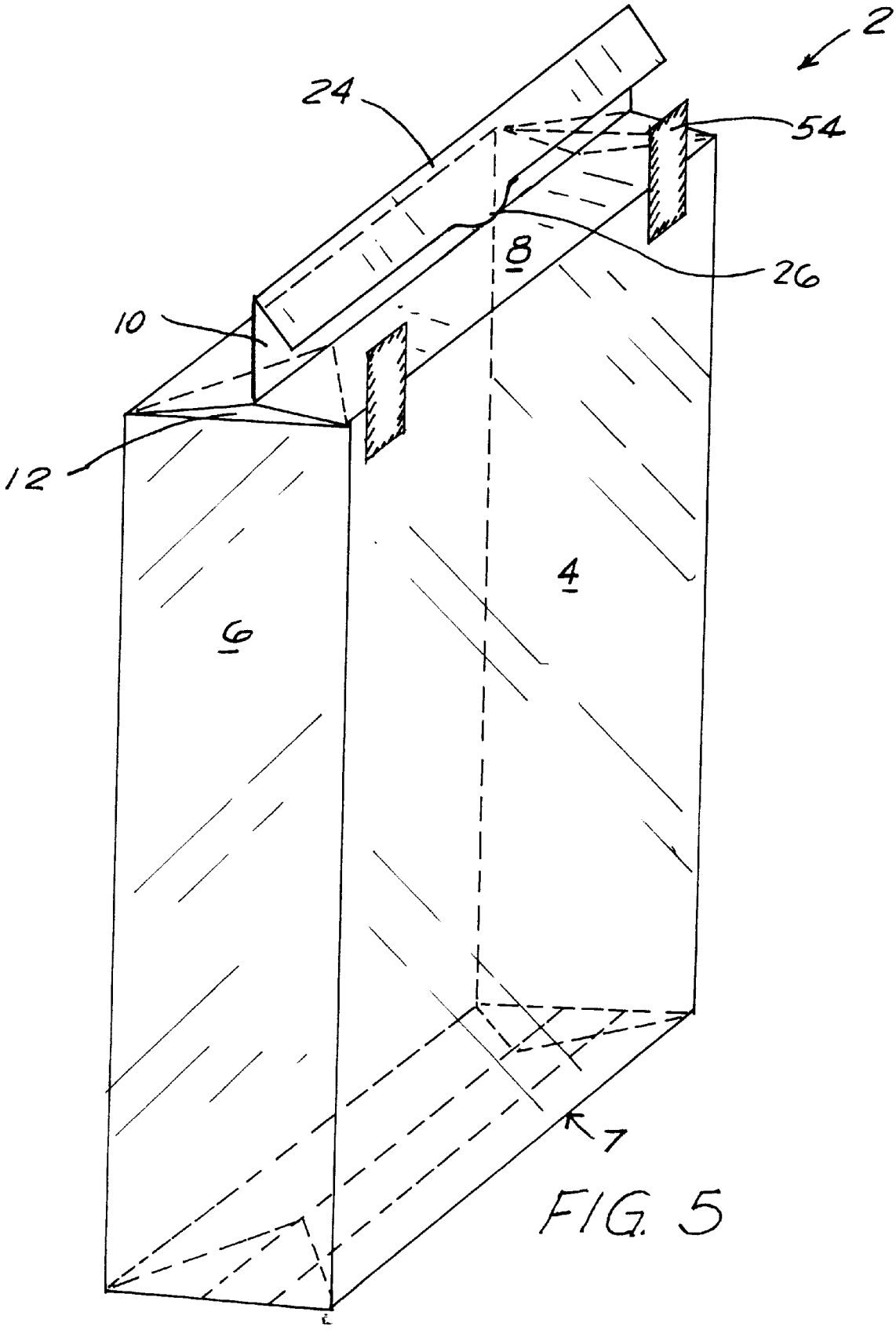
FIG. 5 is an isometric view of another bagless, barrier paperboard box with a reclose feature, according to the present invention.

FIG. 5 shows that tin ties or conventional adhesive strips 54 can be used to adhere fold over panel 10 to end panel 8 in order to reclose box 2.

Figure 6:
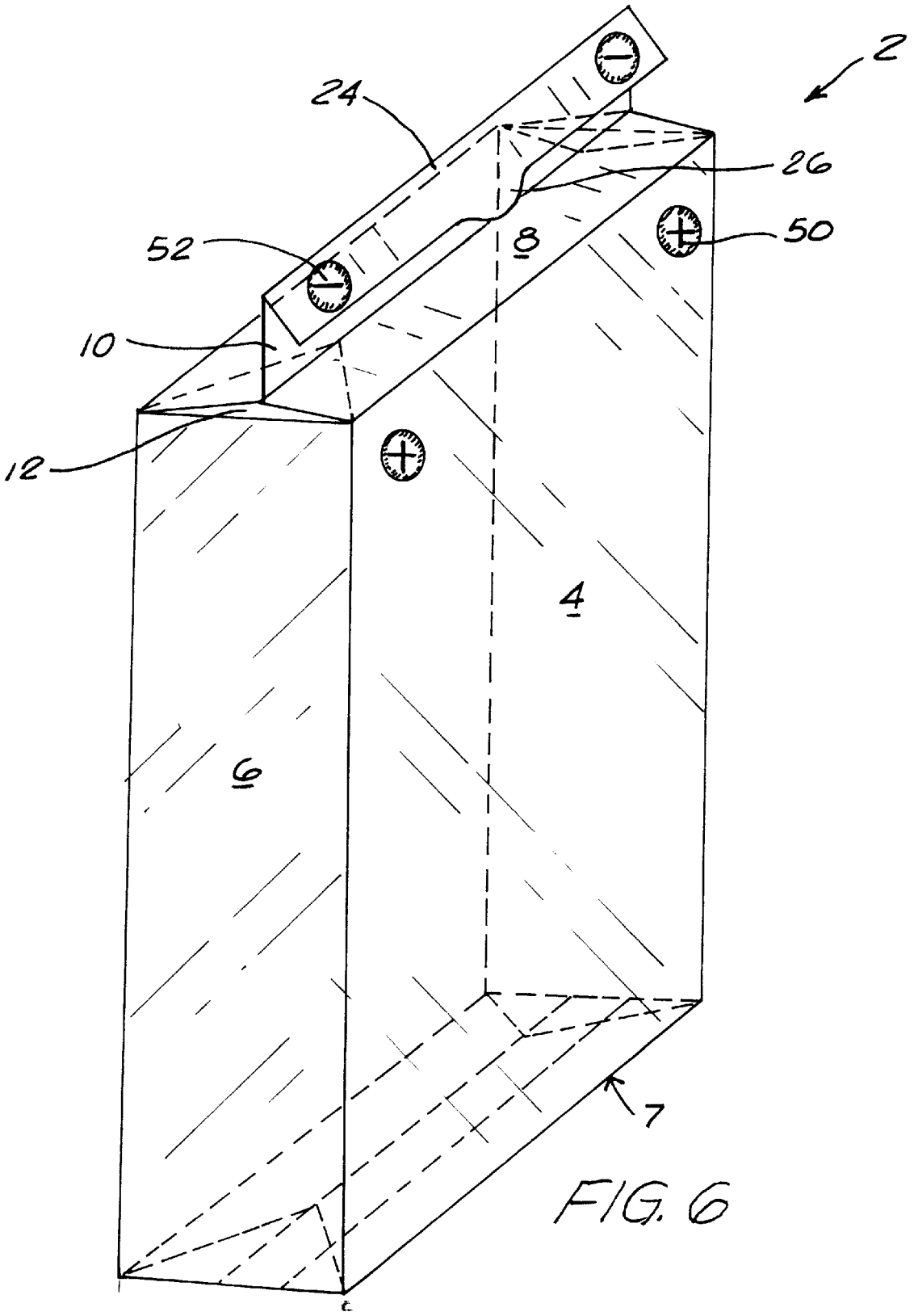
FIG. 6 is an isometric view of another bagless, barrier paperboard box with a reclose feature, according to the present invention.

FIG. 6 is similar to FIG. 3 except that reclose fastener 52 is now located on the inner surface of flap 24 and reclose fastener 50 is now located on side panel 4, instead of end panel 8.

Figure 7:
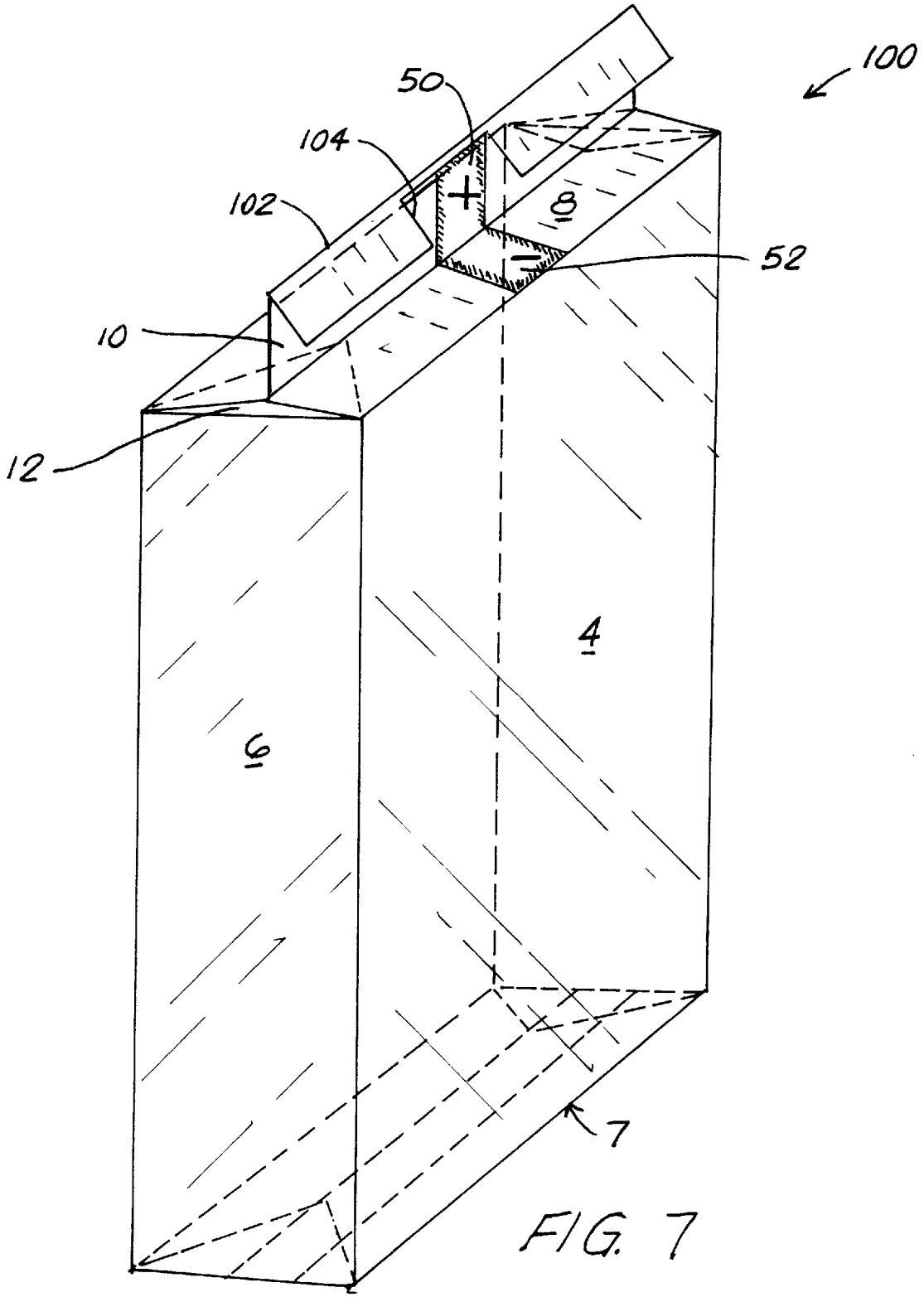
FIG. 7 is an isometric view of another bagless, barrier paperboard box with a reclose feature, according to the present invention.

FIG. 7 illustrates box 100. Box 100 includes many of the same elements as box 2 except for a new configuration of flap 102. In particular, flap 102 contains conventionally constructed notch 104. As can be seen further in FIG. 7, locking, reclosing fasteners 50 and 52 are located on fold over panel 10 and end panel 8, respectively.

Figure 8:
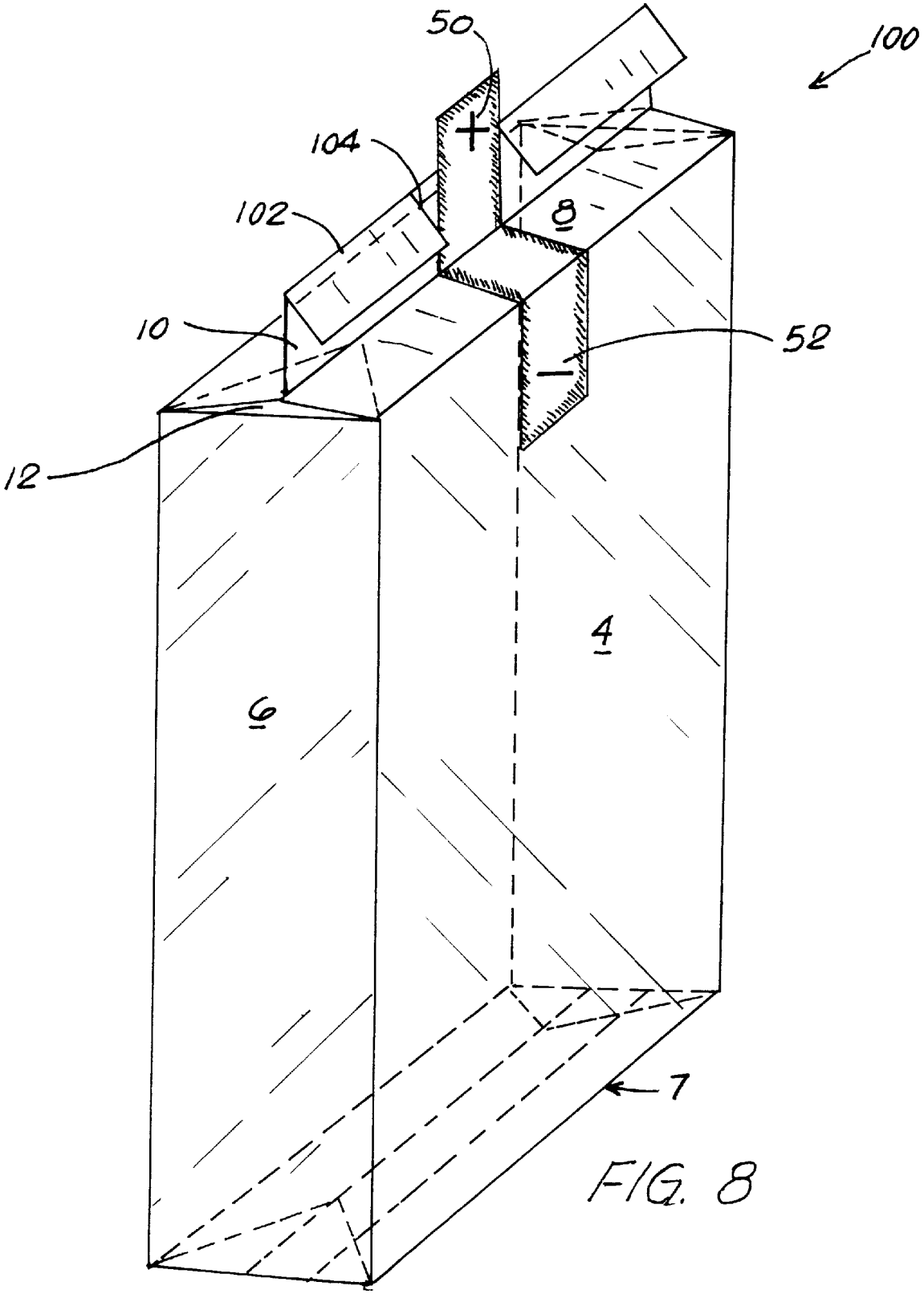
FIG. 8 is an isometric view of another bagless, barrier paperboard box with a reclose feature, according to the present invention.

FIG. 8 is similar to FIG. 7 except that locking, reclosing fastener 52 is located on side panel 4. Also, locking, reclosing fastener 50 extends beyond fold over panel 10 in order to allow fastener 50 to engage fastener 52.

Figure 9:
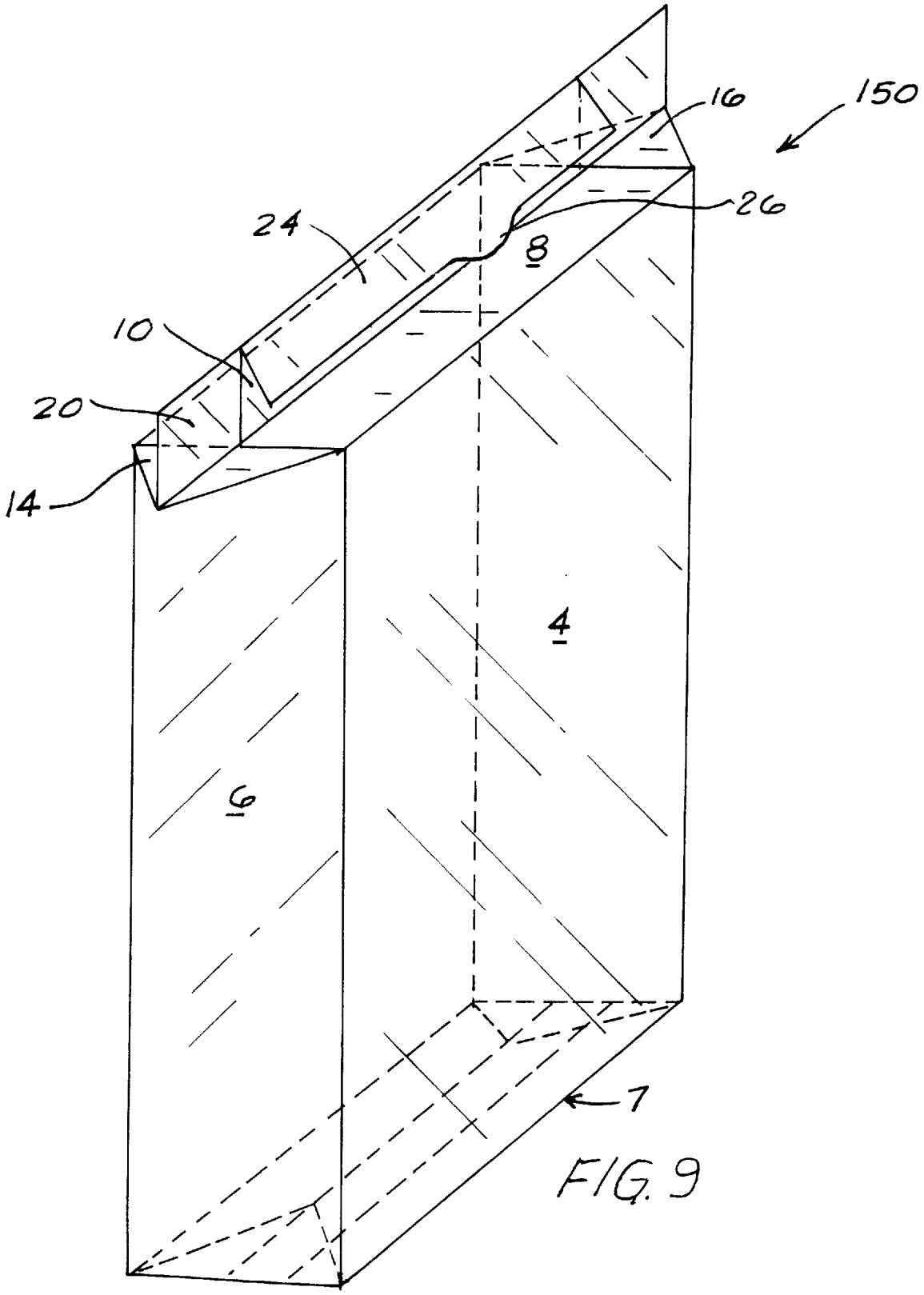
FIG. 9 is an isometric illustration of another bagless, barrier paperboard box in a folded condition, prior to locking, according to the present invention.

FIG. 9 illustrates still another box 150. Box 150 includes many of the same elements of box 2 except that box 150 is now folded in order to be fin-sealed.

Figure 10:
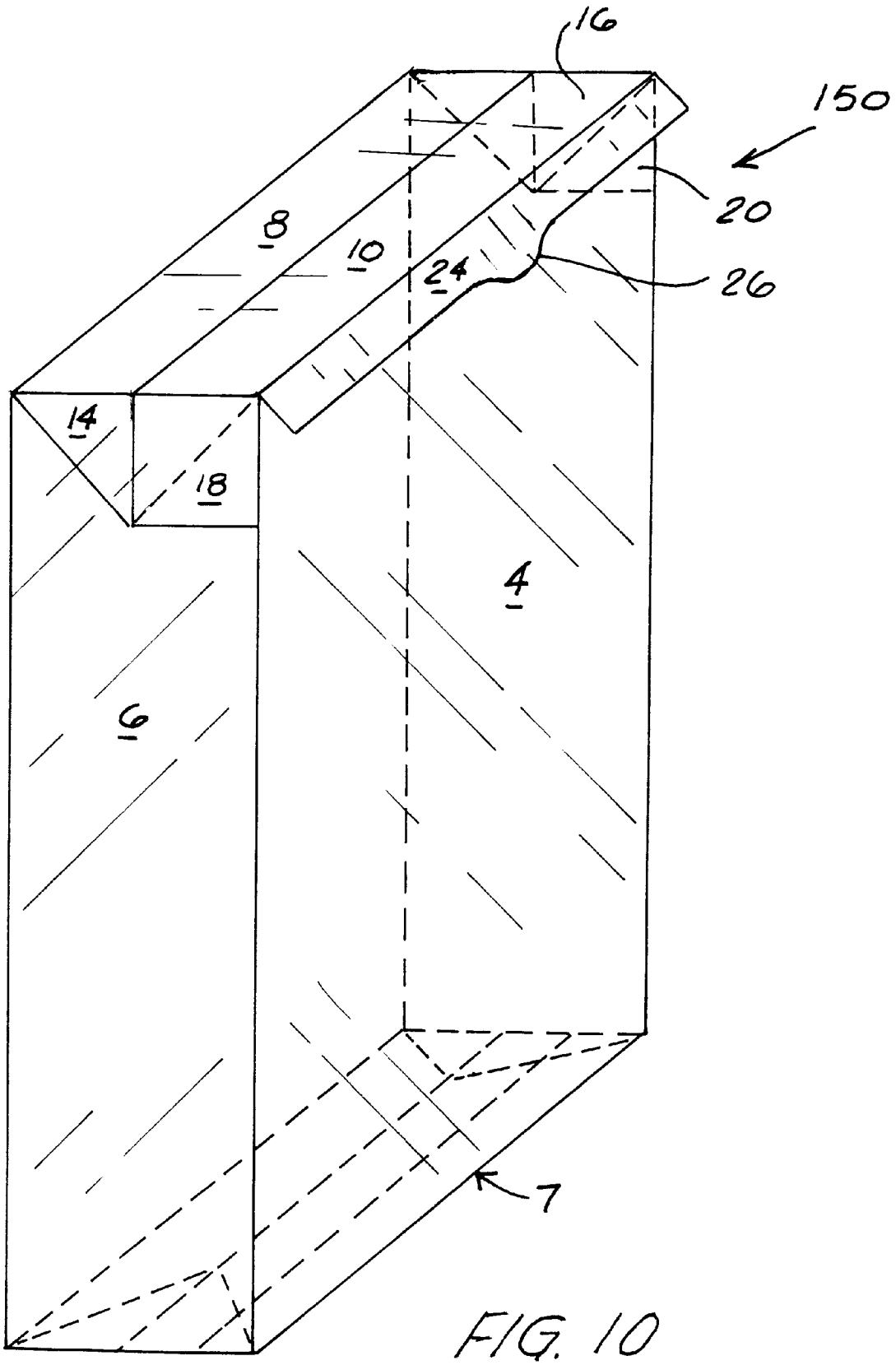
FIG. 10 is an isometric illustration of the bagless, barrier paperboard box of FIG. 9 in a folded condition, prior to locking, according to the present invention.

As further shown in FIG. 10, box 150 is folded such that flap 24 contacts side panel 4. Also, fold-back panels 14 and 16 contact side 6. Finally, a portion of inner rib panel 20 contacts side panel 6.

Figure 11:
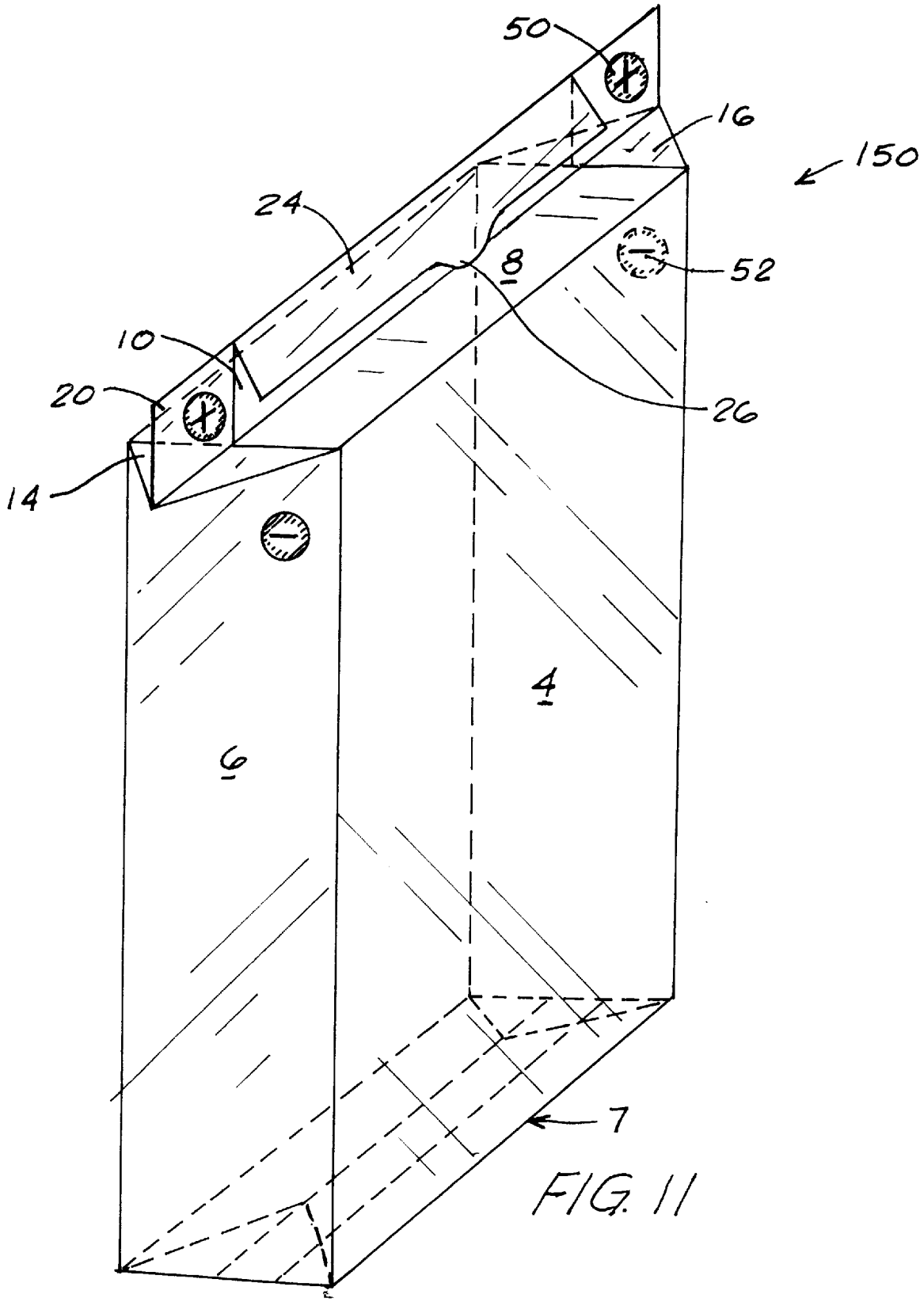
FIG. 11 is an isometric view of another bagless, barrier paperboard box with a reclose feature, according to the present invention.

FIG. 11 illustrates locking, reclosing fasteners 50 and 52 on box 150. In particular, fastener 50 is located on inner rib panel 20 and locking, reclosing fastener 52 is located on side panel 6.

Figure 12:
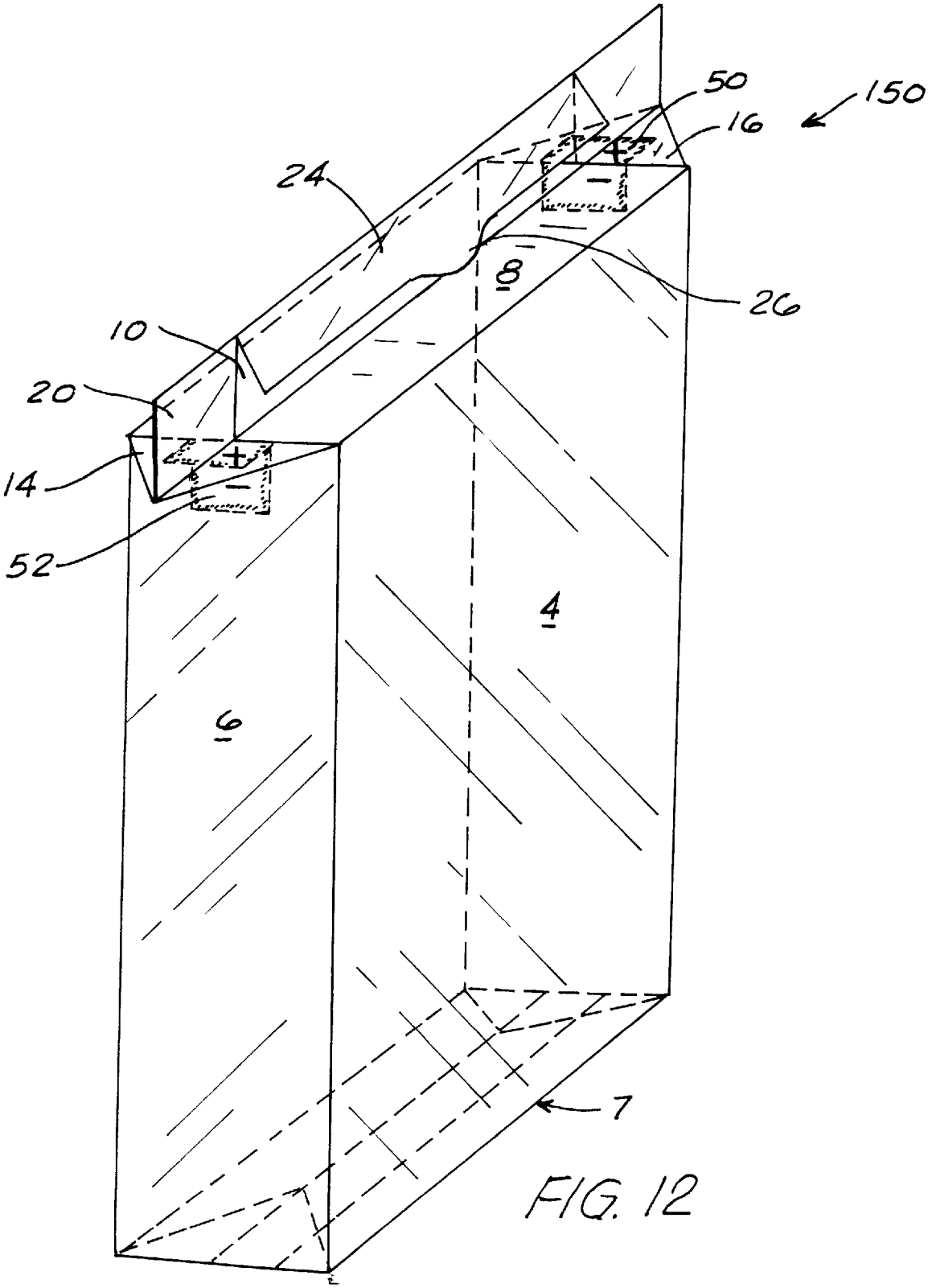
FIG. 12 is an isometric view of another bagless, barrier paperboard box with a reclose feature, according to the present invention.

FIG. 12 illustrates that locking, reclosing fasteners 50 and 52 can be located directly on fold-back panels 14 and 16 in order to secure them to end panel 6.

Figure 13:
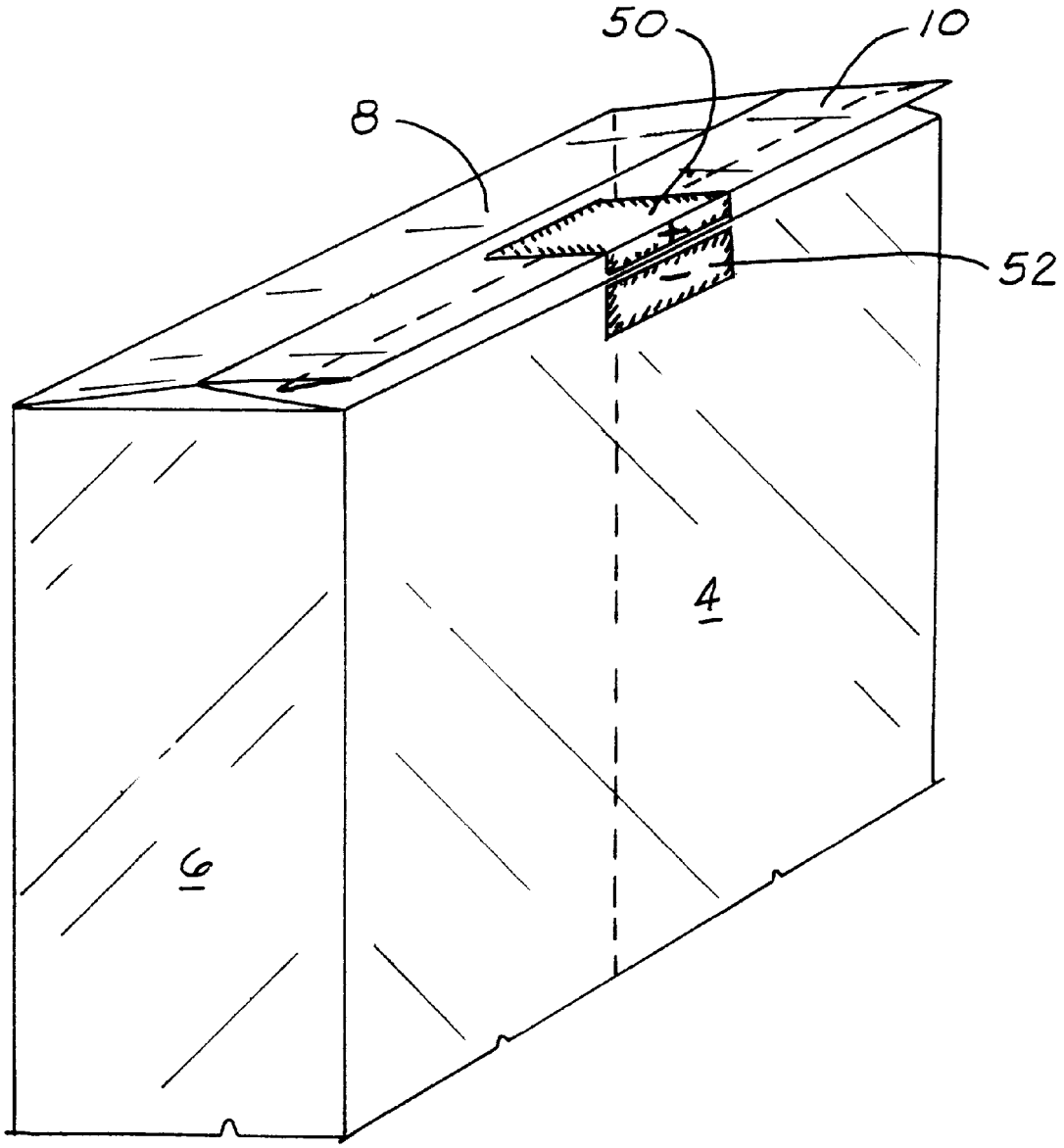
FIG. 13 is an isometric view of another bagless, barrier paperboard box with a reclose feature, according to the present invention.
Figure 14:
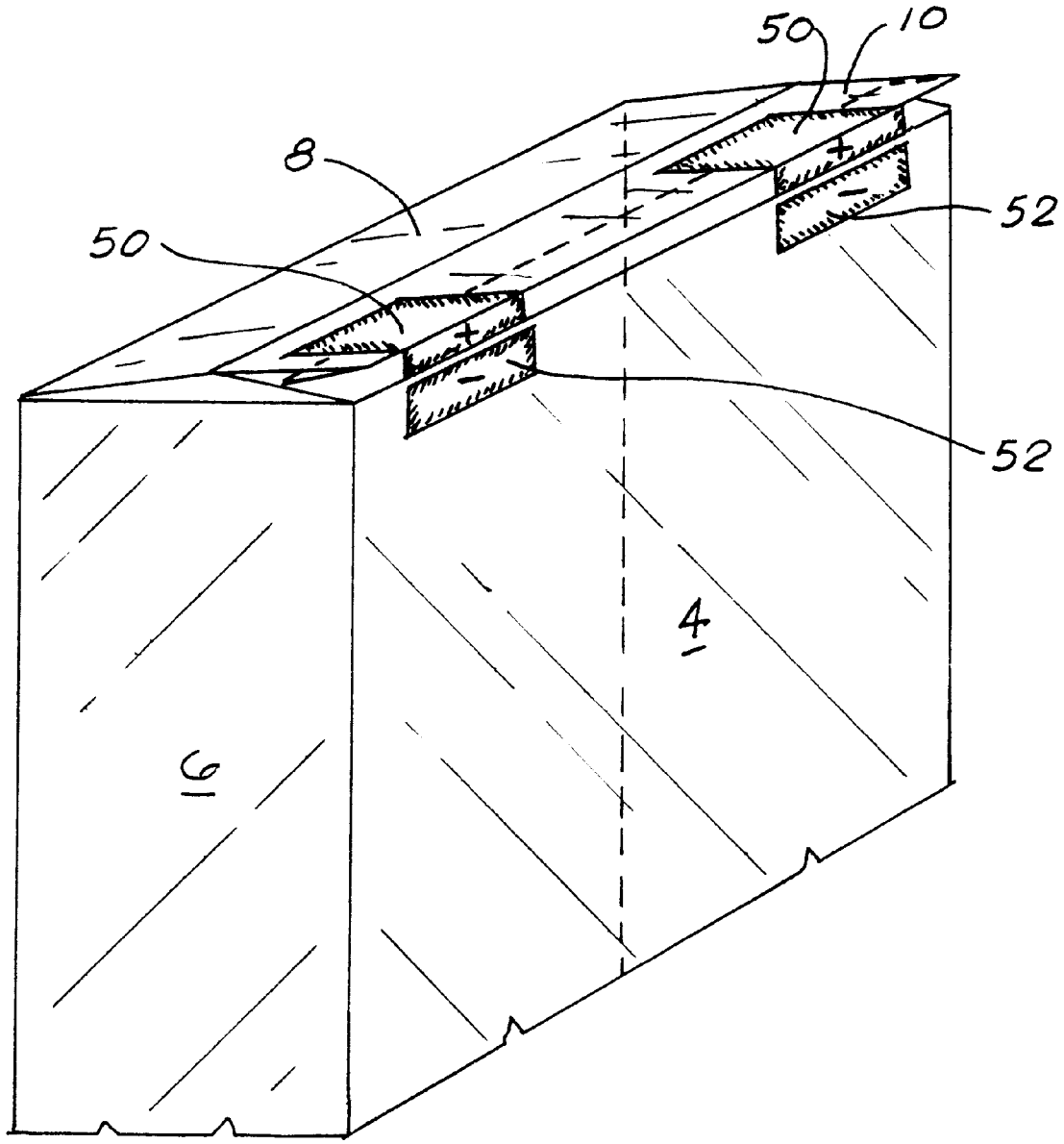
FIG. 14 is an isometric view of another bagless, barrier paperboard box with a reclose feature, according to the present invention.
Figure 16:
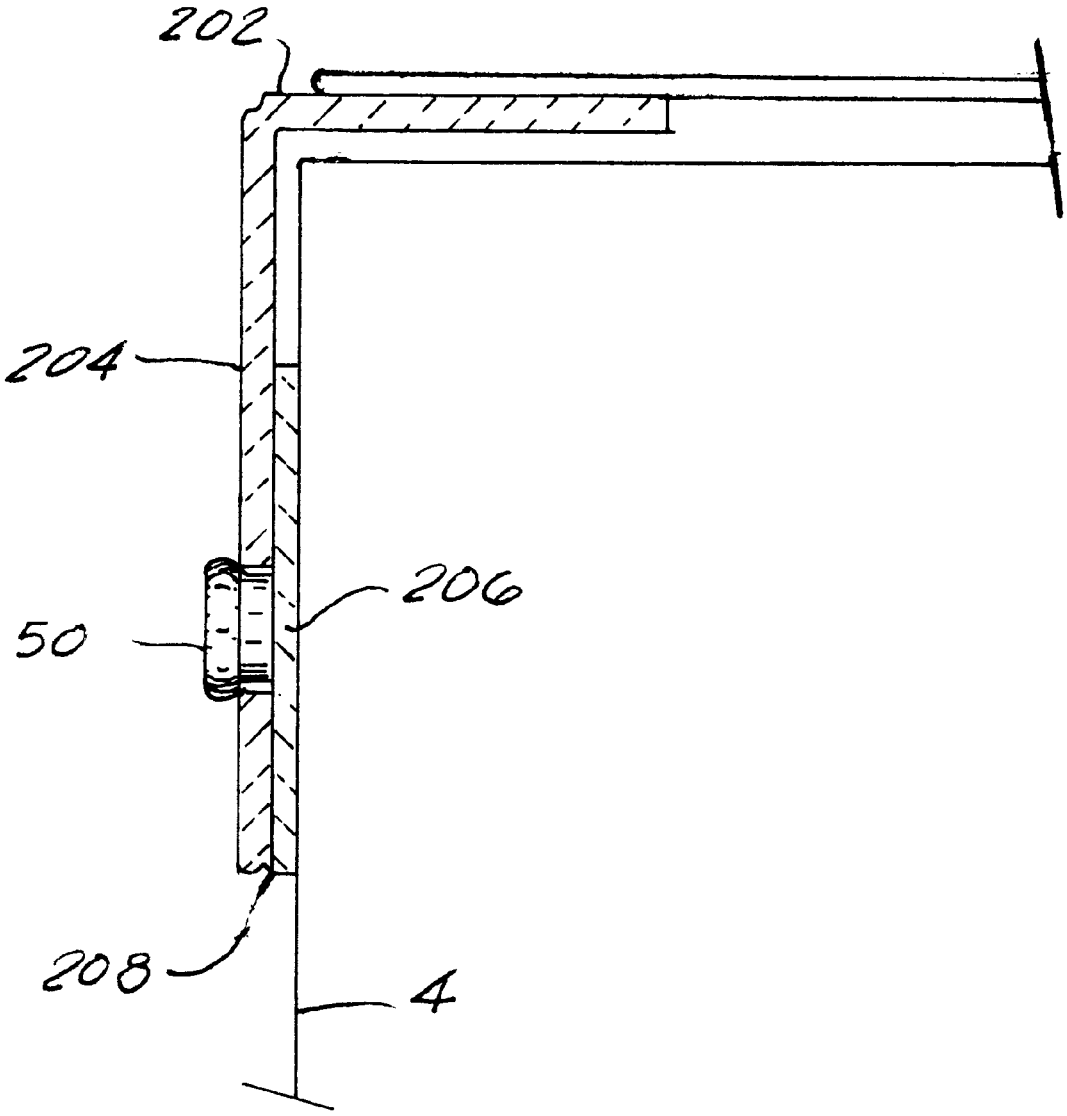
FIG. 16 is a side view which shows the locking, reclosable device of FIG. 15 attached to the side of the bagless, barrier paperboard box, according to the present invention.

FIGS. 13 and 14 illustrate that locking, reclosing fastener 50 and 52 can be located directly on side panel 4 and fold-over panel 10.

FIG. 15 illustrates a molded, hinged fitment 200. Fitment 200, preferably, is constructed of any suitable polymeric material, including but not limited to low density polyethylene, high density polyethylene, linear low density polyethylene and polypropylene. Fitment 200 includes, in part, locking, reclosing fasteners 50 and 52. Fastener 52 also includes ridges 54 which assist in centering fastener 50 within fastener 52. Also, fitment 200 includes plates 202, 204 and 206. A score line 208 is conventionally scored between plates 204 and 206. When bent at the score line 208, the fastener 50 will automatically snap into fastener 52 as shown in FIG. 14. Score line 208 provides evidence of tampering in that once fasteners 50 and 52 are separated, score line 208 will break thus separating fasteners 50 and 52 and thereby providing evidence of tampering. After breaking score line 208, fasteners 50 and 52 will act as a button snap.

It is to be understood that fitment 200 can be attached to any of the boxes 2, 100 or 150 via heat sealing or adhesive (preferably hot melt adhesive). The size of fitment 200 depends on the size of box 2, 100 or 150. The number of fitments 200 per carton is variable depending on the end use requirement and the length of the top of the box.

Figure 18:
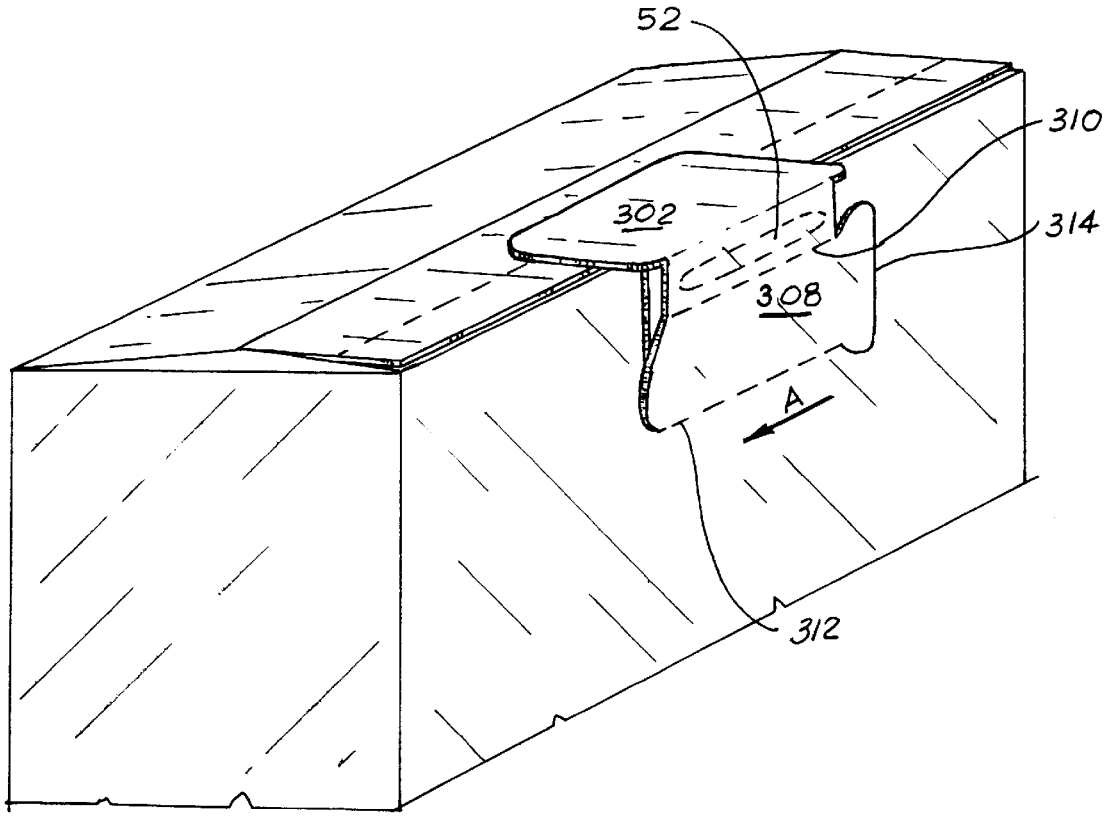
FIG. 18 is a side view which shows the locking, reclosable device of FIG. 17 attached to the side of the bagless, barrier paperboard box, according to the present invention.
Figure 19:
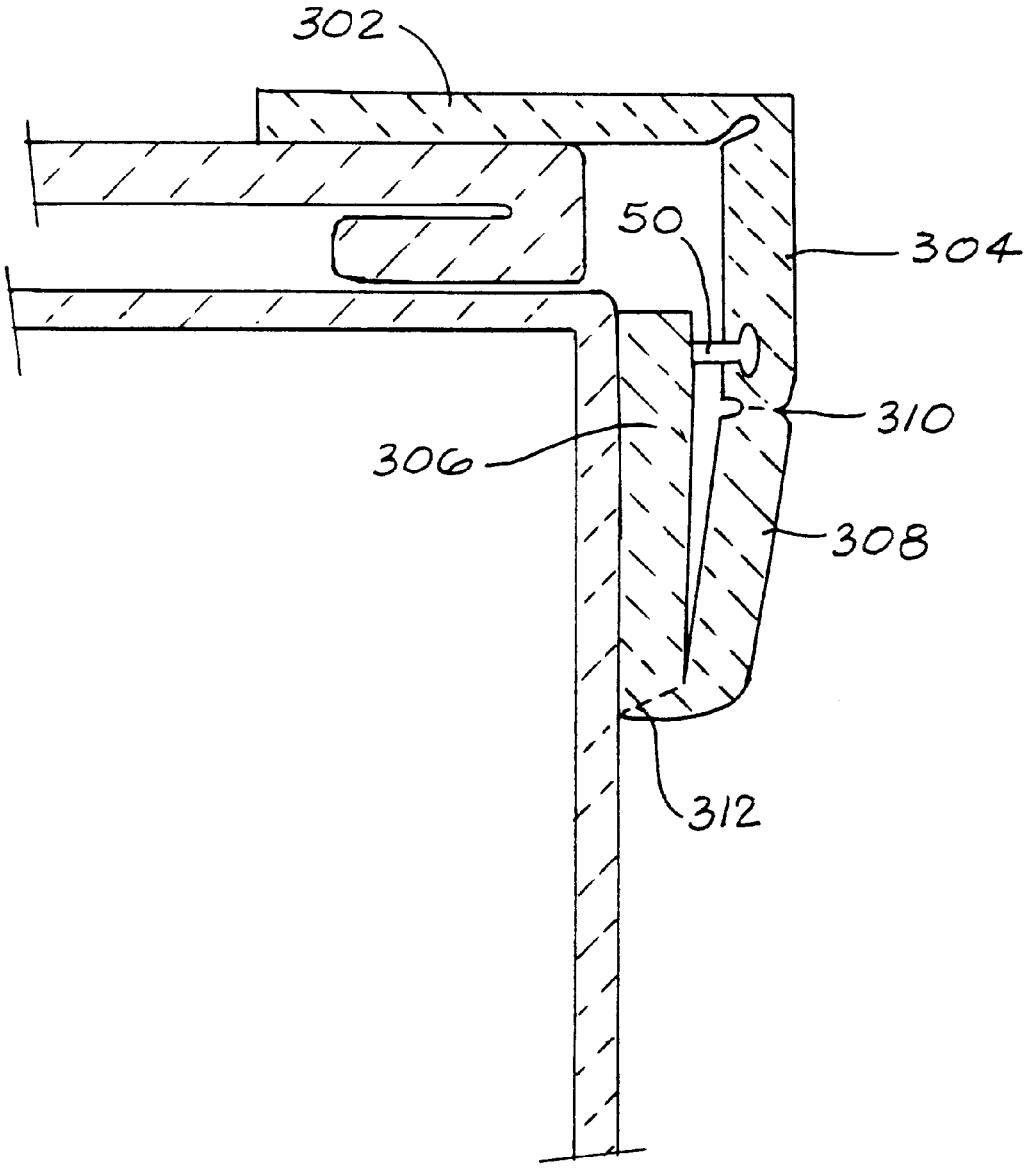
FIG. 19 is a side view which shows the locking, reclosable device of FIG. 17 attached to the side of the bagless, barrier paperboard box, according to the present invention.

FIG. 17 illustrates a molded, hinged fitment 300. Fitment 300, preferably, is constructed of any suitable polymeric material, including but not limited to low density polyethylene, high density polyethylene, linear low density polyethylene and polypropylene. Fitment 300 includes, in part, a locking, reclosing fasteners 50 and 52. Also, fitment 300 includes plates 302, 304, 306, 308 and tab 314 along the direction of arrow A. Score lines 310 and 312 are conventionally scored between plates 304, 306 and 308. When bent at the score line 312, the fastener 50 will automatically snap into fastener 52 as shown in FIGS. 18 and 19. FIG. 18 also, better illustrates the location of tab 314. Score lines 310 and 312 provide evidence of tempering in that once fasteners 50 and 52 are separated, by pulling on tab 314, score lines 310 and 312 will break thus separating fasteners 50 and 52 and thereby providing evidence of tampering. After breaking score line 310 and 312, fasteners 50 and 52 will act as a button snap.

It is to be understood that fitment 300 can be attached to any of the boxes 2, 100 or 150 via heat sealing or adhesive (preferably hot melt adhesive). The size of fitment 300 depends on the size of box 2, 100 or 150. The number of fitments 300 per carton is variable depending on the end use requirement and the length of the top of the box.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A paperboard container to be used without a bag for dry food packaging having a locking, reclosable means, wherein said container is comprised of:

inner and outer sides with printed graphics being located on said outer side and a coating layer located on said inner side, and further including a first side panel hingedly connected to a second side panel along a first vertical side panel score line;

a third side panel hingedly connected to said second side panel along a second vertical side panel score line;

a fourth side panel hingedly connected to said third side panel along a third vertical side panel score line;

a first end panel hingedly connected to said first side panel;

a second end panel hingedly connected to said third side panel;

a first fold over panel hingedly connected to said first end panel;

a second fold over panel hingedly connected to said second end panel;

a flap hingedly connected to said second fold over panel;

a triangular end panel hingedly connected to said second and fourth side panel;

a plurality of fold-back panels hingedly connected to said triangular end panel and said first and second end panel;

a plurality of inner rib panel hingedly connected to said fold-back panels and said first and second fold over panel; and a locking, reclosable means for holding said flap in a reclosable and lockable condition, wherein said locking, reclosable means is further comprised of a polymeric fitment, wherein said fitment is further comprised of a hole having ridges located substantially within said hole, a protuberance located a predetermined distance away from said hole, and a breakaway means located substantially between said hole and said protuberance to provide evidence of tampering.

2. The container, as in claim 1, wherein said flap is further comprised of:

a notch located substantially along a portion of said flap.

3. The container, as in claim 1, wherein said locking, reclosable means is located substantially between said end panel and said flap.

4. The container, as in claim 1, wherein said locking, reclosable means is located substantially between said side panel and said fold over panel.

5. The container, as in claim 1, wherein said locking, reclosable means is located substantially between said side panel and said flap.

6. The container, as in claim 1, wherein said locking, reclosable means is located substantially between said end panel and said fold over panel.

7. The container, as in claim 1, wherein said locking, reclosable means is located substantially between said side panel and said inner rib panel.

8. The container, as in claim 1, wherein said locking, reclosable means is located substantially between said side panel and said fold back panel.

9. The container, as in claim 1, wherein said first and second fold over panels are further comprised of:

tabs located substantially along said first and second fold over panels.

* * * * *

UNITED STATES PATENT AND TRADEMARK OFFICE

CERTIFICATE OF CORRECTION

PATENT NO. : 6,047,883

DATED : Apr. 11, 2000

INVENTOR(S) : Barry Gene Calvert, Janice Lynn Kirkham and Jack Leong Hung Lum

It is certified that error appears in the above-indentified patent and that said Letters Patent is hereby corrected as shown below:

ABSTRACT - line 1, "integrate" should be --integrated--; line 2, "combine" should be --combined--; line 6, "feature" should be --features--; line 7, "an" should be --and--. Column 1, line 7, "integrate" should be --integrated--; line 8, "combine" should be --combined--; line 12, "feature" should be --features--; line 13, "an" should be --and--; line 41, "5,716,4" should be --5,716,473--. Column 2, line 32, delete "flap". Column 5, line 11, after "clearly" insert --in Figures 15a and 15b--.

Signed and Sealed this

Sixth Day of March, 2001

Nicholas P. Godici

*Attest:*

NICHOLAS P. GODICI

*Attesting Officer*

*Acting Director of the United States Patent and Trademark Office*